US010935340B1

(12) United States Patent
Joukov et al.

(10) Patent No.: US 10,935,340 B1
(45) Date of Patent: Mar. 2, 2021

(54) AUTOMATED TOY DART LAUNCHER WITH MOTORIZED DRIVEN DRUM

(71) Applicant: BULLSEYE LIMITED, Hong Kong (HK)

(72) Inventors: Oleg Joukov, Shar Efraim (IL); Herman Joukov, Shar Efraim (IL)

(73) Assignee: BULLSEYE LIMITED, Sheung Wan (CN)

( * ) Notice: Subject to any disclaimer, the term of this patent is extended or adjusted under 35 U.S.C. 154(b) by 0 days.

(21) Appl. No.: 17/046,788

(22) PCT Filed: Jan. 31, 2019

(86) PCT No.: PCT/IB2019/050779
§ 371 (c)(1),
(2) Date: Oct. 11, 2020

(87) PCT Pub. No.: WO2019/197910
PCT Pub. Date: Oct. 17, 2019

(30) Foreign Application Priority Data

Apr. 11, 2018 (GB) ..... 1805962

(51) Int. Cl.
*F41B 7/08* (2006.01)
*F41B 7/00* (2006.01)

(52) U.S. Cl.
CPC ..... *F41B 7/006* (2013.01)

(58) Field of Classification Search
CPC .... F41B 7/00; F41B 7/006; F41B 7/08; F41B 11/54; F41B 11/89; F41A 9/26; F41A 9/73
USPC ..... 446/473; 124/26, 27, 48, 78
See application file for complete search history.

(56) References Cited

U.S. PATENT DOCUMENTS 3,009,453 A * 11/1961 Ayala ..... F41B 7/006 124/27
4,694,815 A * 9/1987 Hung ..... F41B 7/006 124/27
5,156,137 A * 10/1992 Clayton ..... F41B 7/00 124/27
5,186,156 A * 2/1993 Clayton ..... F41B 11/54 124/59
5,213,089 A * 5/1993 DeLuca ..... F41B 7/006 124/29
5,323,755 A * 6/1994 Hsieh ..... F41B 11/54 124/59
5,522,374 A * 6/1996 Clayton ..... F41B 11/54 124/48
5,535,729 A * 7/1996 Griffin ..... F41B 11/54 124/48
5,660,159 A * 8/1997 Clayton ..... F41B 11/54 124/59
5,680,853 A * 10/1997 Clayton ..... F41B 11/54 124/59

(Continued)

*Primary Examiner* — Alexander R Niconovich
(74) *Attorney, Agent, or Firm* — Mark David Torche; Patwrite Law

(57) ABSTRACT

An automated gun-like shaped toy projectiles launcher with motorized driven drum is described. A method of launching a plurality of toy projectiles using an automated toy launcher is further described. The automated toy launcher includes a mechanism including a biasing element configured to accumulate energy upon rotation of the motorized driven drum.

18 Claims, 3 Drawing Sheets

(56) References Cited

U.S. PATENT DOCUMENTS 5,797,385 A * 8/1998 Thai ..... F41B 11/89 124/59
7,677,232 B2 * 3/2010 Rosenblum ..... F41J 9/08 124/16
8,113,188 B2 * 2/2012 Ma ..... F41B 11/641 124/59
8,118,637 B2 * 2/2012 De La Torre ..... F41B 7/003 446/473
8,127,753 B1 * 3/2012 Brooks ..... F41B 11/55 124/66
8,127,754 B1 * 3/2012 Johnson ..... F41B 11/646 124/66
8,353,277 B2 * 1/2013 Huebl ..... F41B 11/89 124/78
8,875,689 B2 * 11/2014 Chor-Ming ..... F41B 11/89 124/80
8,875,690 B2 * 11/2014 Chor-Ming ..... F41B 11/54 124/82
8,997,727 B1 * 4/2015 Hamel ..... F41B 7/003 124/10
9,004,052 B1 * 4/2015 Poirier ..... F41B 7/08 124/27
9,027,541 B2 * 5/2015 Huebl ..... F41B 11/681 124/56
9,513,075 B2 * 12/2016 Lallier ..... F41A 9/73
9,958,230 B1 * 5/2018 Nugent ..... F41A 9/73
10,488,143 B2 * 11/2019 Victor ..... F41A 9/66
10,533,821 B2 * 1/2020 Chia ..... A63F 9/0252
10,823,527 B2 * 11/2020 Tino ..... F41B 11/723
10,859,337 B1 * 12/2020 Bernal ..... F41B 4/00
2007/0101982 A1 * 5/2007 Ong ..... F41B 11/646 124/65
2010/0180878 A1 * 7/2010 Funaki ..... F41B 11/646 124/66
2011/0041823 A1 * 2/2011 Victor ..... F41B 4/00 124/48
2011/0041824 A1 * 2/2011 Jablonski ..... F41B 11/54 124/65
2013/0118465 A1 * 5/2013 Nugent ..... F41B 11/646 124/65
2013/0239936 A1 * 9/2013 Victor ..... F41B 3/03 124/16
2013/0312726 A1 * 11/2013 Mead ..... F41A 9/63 124/78

* cited by examiner

AUTOMATED TOY DART LAUNCHER WITH MOTORIZED DRIVEN DRUM

TECHNICAL FIELD

In general, the present invention pertains to the art of toys. In particular, the invention relates to an automated gun-like shaped toy launcher with motorized driven dart drum.

BACKGROUND ART

It is believed that the state of the art is represented by the following patent literature: U.S. Pat. Nos. 8,402,958, 8,127,753, 9,004,052 and 9,097,477.

Rubber suction cups were first used on the tip of projectile toys at the beginning of the $20^{th}$ century. Toy darts and toy arrows tipped with a suction cup have unique advantages. A dart tipped with a suction cup is relatively safe, being unlikely to cause damage to any person or object it strikes. The suction cup acts as a large blunt rubber tip. However, unlike other blunt tip configurations, a toy dart or arrow with a suction cup has the ability to stick to a smooth flat surface. Darts and arrows with suction cup tips, therefore, have more play value than similar toy darts and arrows that have simple blunt tips.

In early toys, suction cups were structures of rubber having a concave face. In later years, synthetic rubber and other elastomeric materials, such as silicone, were used. When the face of the suction cup struck a hard, flat object, the concave face of the suction cup would partially flatten and the rubber would seal against the impacted surface. The pressure inside the suction cup would, therefore, be lower than the air pressure surrounding the suction cup and the suction cup would adhere to the impacted surface. As air leaked back into the suction cup, it would detach from the impacted surface.

Traditional suction cups made from elastomeric materials work well if they squarely impact a hard, flat surface, such as a window pain or the metal door of a refrigerator.

SUMMARY

A method of launching a plurality of toy projectiles and an automated launcher are provided.

In some embodiments the automated toy projectiles launcher includes: a rotatable driven drum, a plurality of barrels configured to accommodate a plurality of toy projectiles, a ratchetting wheel comprising a plurality extending protrusions, at least one structural element configured to sustain rotation of the drum, at least one structural element configured to transfer driving rotational torque to said drum, an electric motor and a portable energy source therefor, and a cocking mechanism configured for shooting the toy projectiles accommodated in the barrels, including a biasing element configured to accumulate energy in a deformed conformation and a dowel configured to deform said biasing element by operatively engaging to the extending protrusions of the ratchetting wheel.

In some embodiments the method further includes, loading a plurality of toy projectiles into the barrels, activating the motor to drive the rotation of the drum, controllably deforming the biasing element of the cocking mechanism and then abruptly releasing the biasing element, and iteratively repeating the deforming and releasing.

In some embodiments the automated toy projectiles launcher includes a drum essentially surrounding the handle of the launcher.

In some embodiments the automated toy projectiles launcher includes an element configured to direct a trajectory of the projectiles, such as a pair of rotatable drums.

In some embodiments the automated toy projectiles launcher includes a ratchetting wheel with a plurality of extending protrusions, at least one biasing element configured to accumulate energy in a deformed conformation, at least one protrusion, coupled to the at least one biasing element, configured for cocking onto the toy projectiles, thereby shooting the toy projectiles, at least one dowel, coupled to said at least one biasing element, said at least one a dowel is operationally engageable to said extending protrusions of said ratchetting wheel, said at least one a dowel is configured to deform said at least one biasing element, at least one structural element configured to sustain rotation of the ratchetting wheel relative to the at least one biasing element, a device configured to form a rotational movement of the ratchetting wheel relative to the at least one biasing element and a portable energy source, configured for powering the device.

In some embodiments the automated toy projectiles launcher is belt-fed.

Definitions

The term darts, as referred to herein, is to be construed as including any type of projectiles and particularly sucker darts, comprising a projectile body furnished with a vacuum cup.

Whenever in the specification hereunder and particularly in the claims appended hereto a verb, whether in base form or any tense, a gerund or present participle or a past participle are used, such terms as well as preferably other terms are to be construed as actual or constructive, meaning inter alia as being merely optionally or potentially performed and/or being only performed anytime in future.

In addition, as used herein, the term "or" is an inclusive "or" operator, equivalent to the term "and/or," unless the context clearly dictates otherwise; whereas the term "and" as used herein is also the alternative operator equivalent to the term "and/or," unless the context clearly dictates otherwise.

DESCRIPTION OF THE DRAWINGS

The present invention will be understood and appreciated more comprehensively from the following detailed description taken in conjunction with the appended drawings in which.

Figure 1:
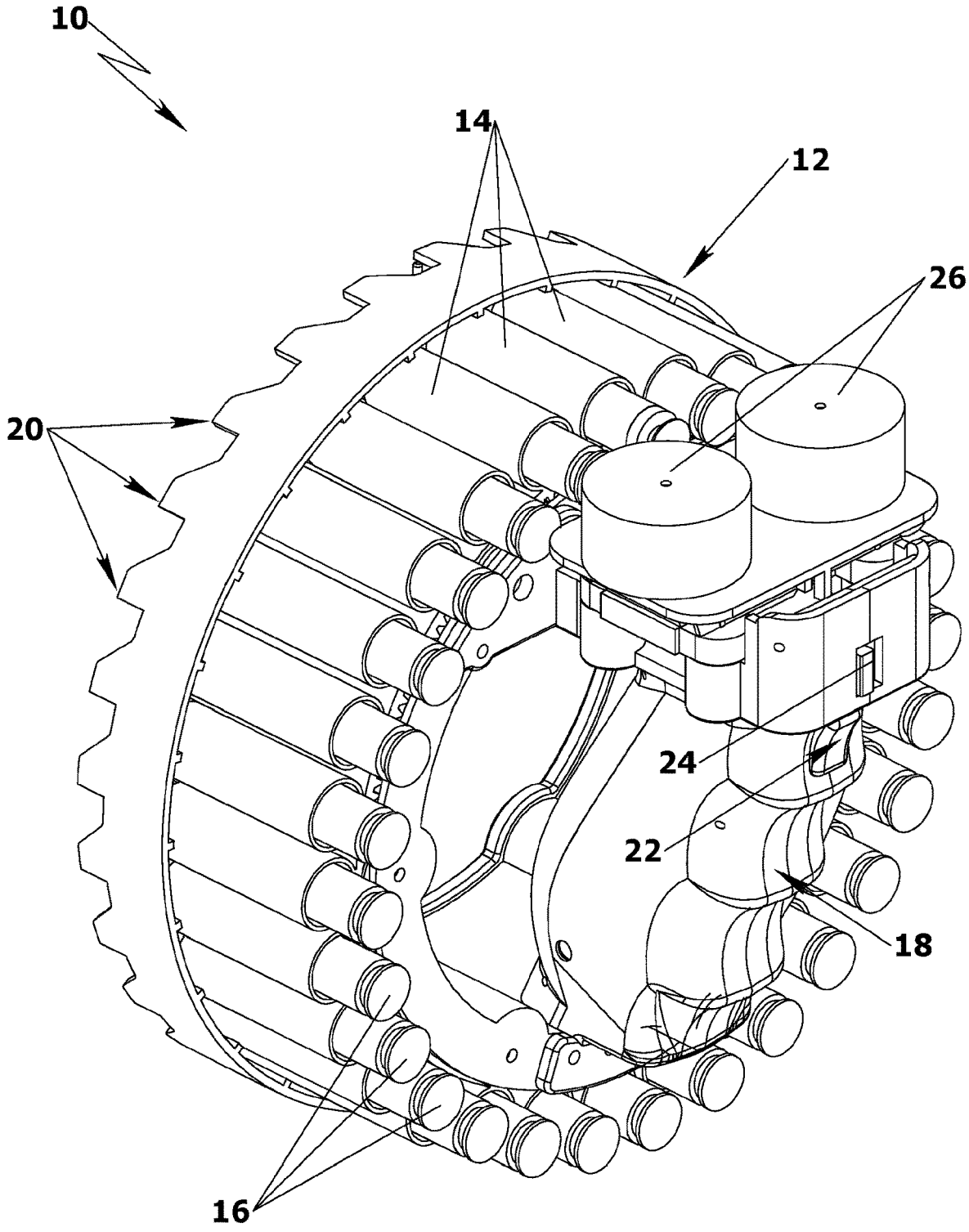
FIG. 1 is an isometric view of an automated toy launcher, with motorized driven dart drum, in accordance with some preferred embodiment of the present invention.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DISCLOSURE OF EMBODIMENTS

Illustrative embodiments of the invention are described below. In the interest of clarity, not all features of actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming, but would nevertheless be a routine undertaking for those of ordinary skill in the art having the benefit of this disclosure.

In accordance with some embodiments of the present invention, reference is now made to FIG. 1, showing gun-like shaped toy launcher 10, with motorized driven dart drum 12. Motorized driven dart drum 12 of gun-like shaped toy launcher 10 comprises a plurality of barrels 14. Motorized driven dart drum 12 comprises a posterior ratchetting wheel, furnished with a plurality of right-angled trapezoid shaped protrusions 20, configured for cocking gun-like shaped toy launcher 10, as elaborated in a more details below.

Barrels 14 of motorized driven dart drum 12 are configured to accommodate a plurality of darts 16, which are preferably sucker darts, as defined hereinabove. Gun-like shaped toy launcher 10 further comprises a pair of guiding drums 26, configured for directing and guiding the dart being shut, such as a dart of darts 16, at the top of motorized driven dart drum 12.

Gun-like shaped toy launcher 10 further comprises handle 18, configured for manually grip. Gun-like shaped toy launcher 10 further comprises trigger 22, configured for actuating motorized driven dart drum 12. Gun-like shaped toy launcher 10 yet further comprises safety catch 24, configured for deactivating trigger 22.

Figure 2A:
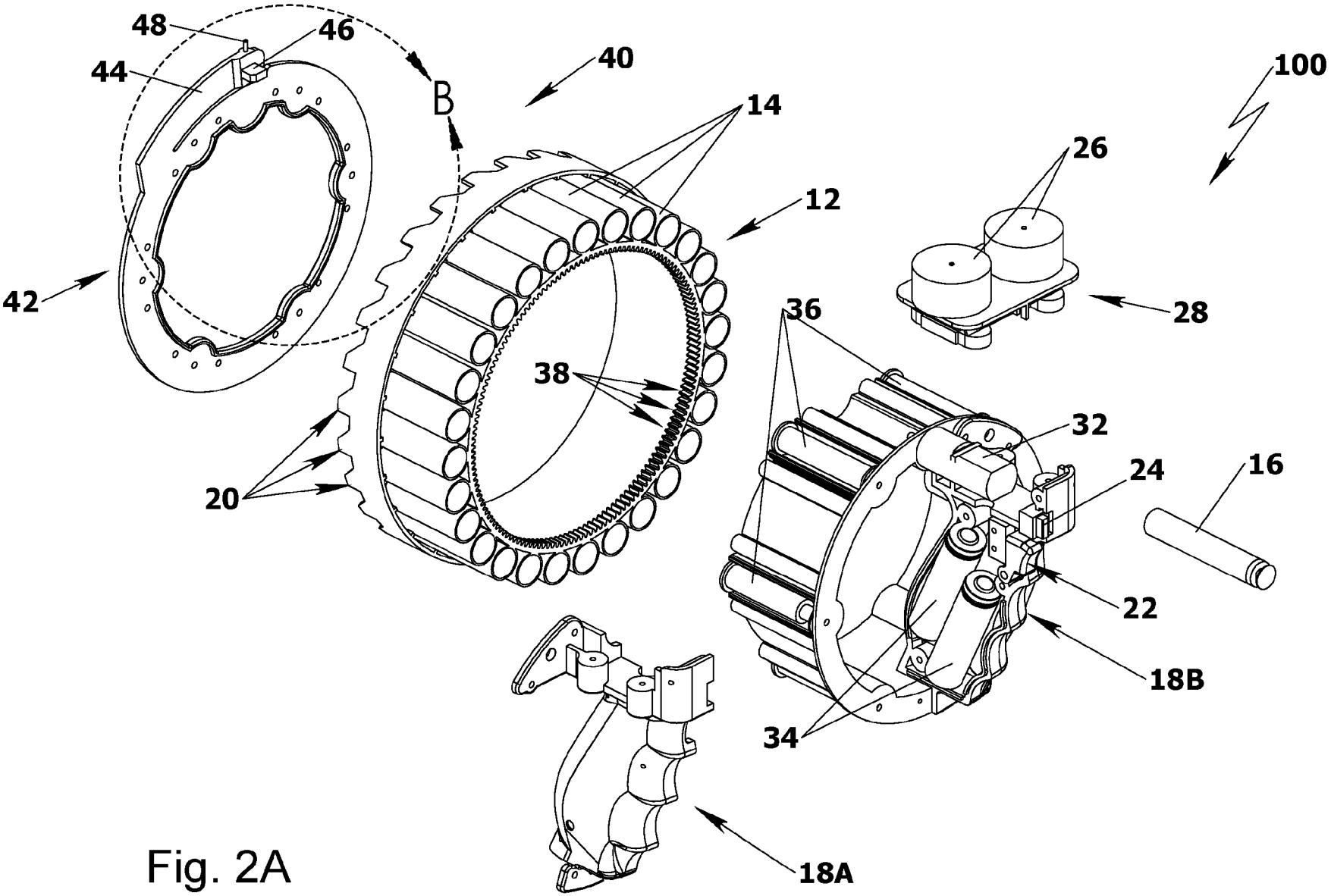
FIG. 2A is an exploded isometric view of an automated toy launcher, with motorized driven dart drum, in accordance with some preferred embodiment of the present invention.
Figure 2B:
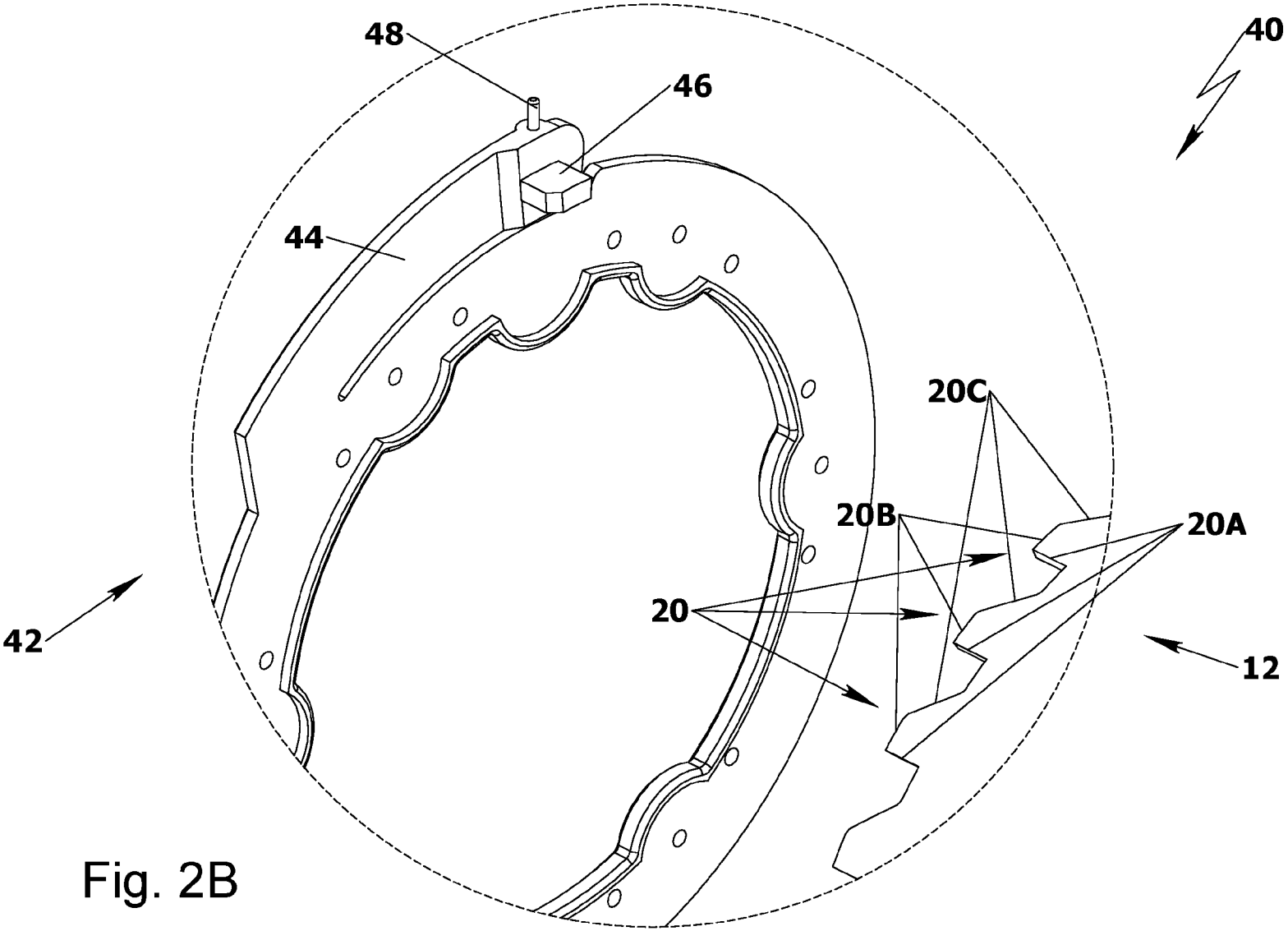
FIG. 2B is an enlarged partial isometric view of the hummer mechanism, of the automated toy launcher with motorized driven dart drum, shown in FIG. 2A.

In accordance with some embodiments of the present invention, reference is now made to FIGS. 2A and 2B, showing an exploded isometric view of automated toy launcher 10 and enlarged partial view of hummer mechanism 40 thereof. The exterior portion of motorized driven dart drum 12 comprises a plurality of gearing cogs 38, furnishing the interior circumference of drum 12. The interior portion of motorized driven dart drum 12, insertable into exterior portion of motorized driven dart drum 12, is connected to handle 18 and furnished with rollers 36, around the exterior circumference thereof. Rollers 36 around the exterior circumference of the interior portion of motorized driven dart drum 12 configured to sustain efficient rotation of exterior portion of motorized driven dart drum 12 around the interior portion of motorized driven dart drum 12, similarly to a bearing.

Handle 18 is connected to the interior portion of motorized driven dart drum 12 comprises a pair of handle shells 18A and 18B. Handle shells 18A and 18B encompass electrical batteries 34, configured to power driving electric motor 32. Handle 18 comprises trigger lever 22, configured to actuate power driving electric motor 32, as well as safety catch 24, configured to activate and/or deactivate the function of the trigger lever 22.

Bridge 26 covers driving electric motor 32 and serves as a platform onto which a pair of guiding drums 26 configured for directing and guiding the dart being shut are mounted. The rotor of driving electric motor 32 is connected to a shaft (not shown) that is furnished with a gearwheel (not shown), the gearing cogs of which are configured to interlock with gearing cogs 38, furnishing the interior circumference of the exterior portion of motorized driven dart drum 12. Consequently, upon actuation of trigger lever 22, rotation of the rotor of driving electric motor 32 drives the rotation of exterior portion of motorized driven dart drum 12, around the interior portion of motorized driven dart drum 12.

Referring particularly to FIG. 2B, showing an enlarged partial isometric view of hummer mechanism 40 of gun-like shaped toy launcher 10. Exterior portion of motorized driven dart drum 12 comprises a posterior ratchetting wheel, furnished with a plurality of right-angled trapezoid shaped protrusions 20, configured for cocking gun-like shaped toy launcher 10. Right-angled trapezoid shaped protrusions 20 comprise perpendicular edges 20A, paralleling edges 20B and slanted edges 20C.

Hummer mechanism 40 of gun-like shaped toy launcher 10, shown in a more detail in FIG. 2B, further comprises posterior hummer wheel 42, configured for cocking gun-like shaped toy launcher 10. Posterior hummer wheel 42 comprises leaf-spring portion 44, configured for being bent and/or posteriorly deflected, thereby accumulating kinetic energy in a deflected confirmation (not shown).

Posterior hummer wheel 42 is affixed to the interior portion of motorized driven dart drum 12, so that upon rotation of exterior portion of motorized driven dart drum 12, posterior hummer wheel 42 and leaf-spring portion 44 remain substantially immobile relatively to the interior portion of motorized driven dart drum 12. Posterior hummer wheel 42 further comprises hummer protrusion 46, configured for shooting the toy darts out of barrels 14, such as toy dart 16 out of barrel 14, at the top of motorized driven dart drum 12.

Posterior hummer wheel 42 further comprises dowel 48, configured to interact with right-angled trapezoid shaped protrusions 20 furnishing the posterior ratchetting wheel of exterior portion of motorized driven dart drum 12. Upon clockwise rotation of the exterior portion of motorized driven dart drum 12, initially dowel 48 is driven posteriorly by slanted edges 20C, of right-angled trapezoid shaped protrusions 20 furnishing the posterior ratchetting wheel of exterior portion of motorized driven dart drum 12.

Subsequently, upon reaching the paralleling edges 20B, of right-angled trapezoid shaped protrusions 20, dowel 48 drives leaf-spring portion 44 of posterior hummer wheel 42 into the posteriorly deflected confirmation (not shown), thereby accumulating sufficient kinetic energy required for cocking gun-like shaped toy launcher 10 and shooting the toy darts out of barrels 14, such as toy dart 16 out of barrel 14, at the top of motorized driven dart drum 12.

Subsequent to that, upon reaching the perpendicular edges 20A, dowel 46 snap off paralleling edges 20B of right-angled trapezoid shaped protrusions 20. Consequently leaf-spring portion 44 of posterior hummer wheel 42 is released form the posteriorly deflected confirmation (not shown), whereby the kinetic energy accumulated in leaf-spring portion 44 is instantly conducted by hummer protrusion 46 to toy dart 16, whereby thereby cocking gun-like shaped toy launcher 10 and shooting the toy darts out of barrels 14, such as toy dart 16 out of barrel 14, at the top of motorized driven dart drum 12.

It is noted that upon continuously actuating trigger lever 22, exterior portion of motorized driven dart drum 12 is continuously rotated, thereby toy darts 16 are automatically discharged from barrels 14, such as toy dart 16 at the top of motorized driven dart drum 12.

In accordance with some preferred embodiments of the present invention, still referring to FIGS. 1 to 2B, dart drum 12 surrounds handle 18 of gun-like shaped toy 10 and rotates essentially around the wrist and/or distal portion of the forearm (not shown) of the shooter (not shown).

It should be acknowledged however that the gun-like shaped toy dart launcher, with the drum surrounding the handle and rotating essentially around the wrist and/or distal portion of the forearm of the shooter, shown in FIGS. 1 to 2B is merely exemplary, whereas belt-fed machinegun shaped toy projectile launcher is equally implementable with the cocking mechanism of the invention, characterized by a spring repeatedly compressed by rotation of a ratcheting wheel.

In other embodiments the cocking mechanism comprises a single static ratcheting extension attached to the body of the gun and a spinning wheel with a plurality of leaf spring or other biasing elements furnished with cocking tips, somewhat resembling a carousel. Accordingly when the wheel spins, each leaf spring or biasing element, in turn, is initially compressed by the static ratcheting extension and then abruptly released, thereby cocking onto the toy projectiles and repeatedly shooting the toy projectiles.

It will be appreciated by persons skilled in the art that the present invention is not limited by what has been particularly shown and described herein above. Rather the scope of the invention is defined by the claims which follow:

The invention claimed is:

1. An automated toy projectile launcher comprises:
- (a) a rotatable driven drum comprising:
  - (I) a plurality of barrels circumferentially disposed on said drum, said barrels are configured to accommodate a plurality of toy projectiles;
  - (II) a ratchetting wheel comprising a plurality of extending protrusions;
  - (III) at least one structural element configured to transfer driving rotational torque to said drum;
- (b) a static launcher portion:
  - (I) a handle, configured for manual gripping;
  - (II) a trigger, configured for activation by a finger;
  - (III) at least one element configured to sustain rotation of said drum relative to said static launcher portion;
  - (IV) an electric motor;
  - (V) a portable energy source, configured for powering said motor;
  - (VI) at least one structural element configured to transfer a rotational torque from said motor to said drum;
  - (VII) a cocking mechanism configured for shooting said toy projectiles accommodated in said barrels, said cocking mechanism comprising:
    - (i) a leaf-spring element, affixed to said static launcher portion, configured for been controllably bent, deformed or deflected, to accumulate energy in a bent, deformed or deflected confirmation;
    - (ii) a protrusion, configured for cocking onto said toy projectiles, thereby shooting said toy projectiles out of said barrels;
    - (iii) a dowel configured to interact with said extending protrusions of said ratchetting wheel.

2. The automated toy launcher, as in claim 1, wherein said drum essentially surrounds said handle of said static launcher portion.

3. The automated toy launcher, as in claim 1, wherein said portable energy source is an electric battery.

4. The automated toy launcher, as in claim 1, further comprises at least one element configured to direct a trajectory of said projectiles.

5. The automated toy launcher, as in claim 4, wherein said at least one element configured to direct a trajectory of said projectiles is a pair of rotatable drums.

6. The automated toy launcher, as in claim 1, wherein said rotatable driven drum further comprises at least one element configured to sustain rotation of said drum relative to said static launcher portion.

7. The automated toy launcher, as in claim 1, wherein said projectiles are belt-fed.

8. A method of launching a plurality of toy projectiles comprises:
- (a) providing an automated toy launcher comprising:
  - (I) a rotatable driven drum comprising:
    - (i) a plurality of barrels configured to accommodate a plurality of toy projectiles;
    - (ii) a ratchetting wheel comprising a plurality extending protrusions;
    - (iii) at least one structural element configured to sustain rotation of said drum;
    - (iv) at least one structural element configured to transfer driving rotational torque to said drum;
  - (II) a static launcher portion comprising:
    - (i) an electric motor;
    - (ii) a portable energy source, configured for powering said motor;
    - (iii) a cocking mechanism configured for shooting said toy projectiles accommodated in said barrels, comprising: a biasing element configured to accumulate energy in a deformed conformation and a dowel configured to deform said biasing element by interacting with said extending protrusions of said posterior ratchetting wheel;
- (b) loading a plurality of toy projectiles into said barrels;
- (c) activating said motor and driving rotation of said drum;
- (d) controllably deforming said biasing element of said cocking mechanism;
- (e) abruptly releasing said biasing element, and
- (f) iteratively repeating said steps controllably deforming and abruptly releasing.

9. The method, as in claim 8, wherein said drum essentially surrounds said handle of said static launcher portion.

10. The method, as in claim 8, wherein said portable energy source is an electric battery.

11. The method, as in claim 8, wherein said automated toy launcher further comprises at least one element configured to direct a trajectory of said projectiles.

12. The method, as in claim 11, wherein said at least one element configured to direct a trajectory of said projectiles is a pair of rotatable drums.

13. The method, as in claim 8, wherein said rotatable driven drum further comprises at least one element configured to sustain rotation of said drum relative to said static launcher portion.

14. An automated toy projectile launcher, configured for shooting a plurality of toy projectiles, said launcher comprises:
- (a) a ratchetting element comprising at least one extending protrusion;
- (b) at least one biasing element configured to accumulate energy in a deformed conformation;
- (c) at least one protrusion, coupled to said at least one biasing element, configured for cocking onto said toy projectiles, thereby shooting said toy projectiles;
- (d) at least one dowel, coupled to said at least one biasing element, said at least one a dowel is operationally engageable to said at least one extending protrusion of said ratchetting element, said at least one a dowel is configured to deform said at least one biasing element;

(e) at least one structural element configured to sustain rotation of said at least one ratchetting element relative to said at least one biasing element;

(f) a device configured to form a rotational movement of said at least one ratchetting element relative to said at least one biasing element;

(g) a portable energy source, configured for powering said device.

15. The automated toy launcher, as in claim 14, further comprises a drum essentially surrounding a handle of said launcher.

16. The automated toy launcher, as in claim 14, wherein said portable energy source is an electric battery.

17. The automated toy launcher, as in claim 14, further comprises at least one element configured to direct a trajectory of said projectiles.

18. The automated toy launcher, as in claim 16, wherein said at least one element configured to direct a trajectory of said projectiles is a pair of rotatable drums.

* * * * *